US007926190B1

(12) United States Patent
Hoffman

(10) Patent No.: US 7,926,190 B1
(45) Date of Patent: Apr. 19, 2011

(54) DUAL INTERCHANGEABLE TYPE BOW SIGHT

(76) Inventor: David J. Hoffman, Appleton, WI (US)

( * ) Notice: Subject to any disclaimer, the term of this patent is extended or adjusted under 35 U.S.C. 154(b) by 0 days.

(21) Appl. No.: 12/587,038

(22) Filed: Sep. 30, 2009

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 4,142,297 | A * | 3/1979 | Altier | 33/265 |
| 4,616,623 | A * | 10/1986 | Williams | 124/87 |
| 4,704,800 | A * | 11/1987 | Stinson | 33/265 |
| 5,040,301 | A * | 8/1991 | Forbis | 33/265 |
| 5,454,169 | A * | 10/1995 | Keller | 33/265 |
| 5,802,726 | A * | 9/1998 | Trosper et al. | 33/265 |
| 6,170,164 | B1 * | 1/2001 | Knowles | 33/265 |
| 6,470,870 | B1 * | 10/2002 | Schaar | 124/25.6 |
| 6,612,299 | B2 * | 9/2003 | Martin et al. | 124/86 |
| 6,796,039 | B2 * | 9/2004 | Walbrink | 33/265 |
| 6,925,721 | B2 * | 8/2005 | Dietz | 33/265 |
| 7,040,027 | B1 * | 5/2006 | Shaffer et al. | 33/265 |
| 7,461,460 | B2 * | 12/2008 | Priebe | 33/265 |
| 7,584,543 | B1 * | 9/2009 | Boyd | 33/265 |
| 7,594,335 | B1 * | 9/2009 | Schmitz | 33/265 |
| 2003/0136012 | A1 * | 7/2003 | Walbrink | 33/265 |
| 2010/0043765 | A1 * | 2/2010 | Lang | 124/25.6 |

* cited by examiner

*Primary Examiner* — Yaritza Guadalupe-McCall

(57) ABSTRACT

A bow sight mounting system including a forward sight assembly used with conjunction with a rearward sight assembly adjustably mounted to a base plate, each component considered modular. The forward sight assembly, interchangeable with identical parts in the rearward sight assembly, includes two pin sight assemblies, two sight mounting brackets and two moveable connecting bars terminating in a base mounting plate. The base mounting plate is symmetrical with the ability to mount on a left-hand or right-hand bow. The moveable connecting bars extends perpendicular to the bow frame and base mounting plate and locates the sight mounting bracket in position to be inline with the bowstring. The forward pin sight assembly containing a vertical pin works with conjunction with the rearward pin sight assembly containing two vertical pins. The rearward vertical pins are positioned as such to create an open gap alignable with the forward pin and the target.

11 Claims, 5 Drawing Sheets

DUAL INTERCHANGEABLE TYPE BOW SIGHT

BACKGROUND OF THE INVENTION

The present invention relates generally to bow sights and more specifically it relates to a modular and interchangeable type bow sight mounting system for providing an archery sighting system which eliminates the need for a peep sight while assisting the archer in maintaining consistent form to circumvent bow torque.

Any discussion of the prior art throughout the specification should in no way be considered as an admission that such prior art is widely known or forms part of common general knowledge in the field.

When a person decides to take up the sport of archery the two required items are the projectile, or arrow, and the mechanism to launch the projectile, the bow. Everything else is an accessory. The present invention generally relates to one of the more important accessories for the archery equipment. More particularly, this invention is related to a bow mounted sighting mechanism which can be used to accurately aim the bow at a target thereby improving the shooting accuracy of the archer.

It has long been recognized that a bow is a difficult weapon to shoot with consistent accuracy. There are two primary systems archers employ in aiming to produce consistent accuracy. The most basic system, or method, is "instinct". Instinct shooters rely on both their shooting experience and their familiarity with their equipment to compensate for the various accuracy influencing factors. Instinct shooting requires a tremendous amount of practice and concentration to be effective. When hunting, the adrenaline of the moment can dramatically influence concentration and aiming at the target becomes considerably more difficult resulting in a complete miss, or worse a poor shot.

The second system the archer may use to improve accuracy is to purchase one of the numerous types of bow sights on the market. Bow sights enable the archer to more consistently hold the bow in the same orientation for a shot at a given distance. The bow sight mounts to the riser of the bow and the sight houses one or more sight pins. The pins are vertically spaced from one another and are individually set by the archer so that each pin corresponds with a predetermined distance to the target.

A problem with this system of alignment device is that the pins each provide only a single reference point to be used in connection with aiming of the bow. What often happens is the orientation or attitude of the bow is altered between successive shots at the same distances so that, merely using the same sight pin will not always result in an accurate shot. This realization has lead to the development of what are herein referred to as secondary sights.

Perhaps the most commonly known secondary sight is the bow string mounted "peep" sight. During its use, the peep is mounted to the bow string and once the bow string is drawn, the archer looks through the peep sight to align the appropriate sight pin on the target. Although generally considered to be better than a single front pin, these systems also have their disadvantages and limitations. One limitation is the difficulty with which a peep is mounted to the bow string so that it will consistently offer a clear view of the sight pins and the target. Another problem, and often more significant, is that when looking through the small aperture of the peep, the amount of light available to the archer for viewing the pin and the target is significantly diminished thereby often drastically inhibiting vision of the target. This is compounded by the fact that the best hunting times are generally considered to occur during the marginal light conditions of dawn and dusk. As the archer ages his/her near-vision usually diminishes compounding further the problems associated with peep sights. The archer then has a tendency to "look over" the peep as adrenaline takes over when aiming at a live target in order to acquire a better view of the target. Looking over the peep is often the cause for a complete miss at a live target. If the archer has both eyes open the low light condition created by the peep can transfer the normally dominate eye to the opposite eye altering the point of impact so much so that the target is completely missed. A solution for low light availability of peep sights is to use a larger peep. However, the larger the peep the more room for sighting error and a less accurate shot results.

Whether a peep is used or not, another aiming problem arises when the archer torques the bow slightly. If the bow is gripped differently or the archer squeezes the handle of the bow, "torque" is produced and is observable at the target as a left or right miss. Bow torque on single sighting systems and single sighting systems in conjunction with a peep is not observable. Only after the arrow is released to the target and a left or right miss is observed is bow torque realized. This realization and the need to eliminate the low light problems associated with peep sights have lead to the development of alternate variety of secondary sights.

An alternate variety of bow sight eliminates the peep and mounts a supplemental rear sight in combination with the front sight. While there are literally hundreds of traditional types of bow sights commercially available, each requiring a peep for best accuracy, there are only a few types of this alternate variety of rear bow sight commercially available. Rear sights in prior art, such as U.S. Pat. No. 5,671,724, have generally included movable parts and a cross hair sight which obstructed visibility of the forward sight and the target itself. This and prior art, such as U.S. Pat. No. 7,275,327 and U.S. Pat. No. 6,003,233, involving complicated aiming techniques, are not built rugged to withstand the occasional snag with brush or other abuse without damage. Preliminary calculations using a torque formula indicate it would take 85 to 125 pounds of force to bend the windage adjustment of the aforementioned bow sights if mounted an inch from the mounting plate. Other prior art, such as U.S. Pat. No. 6,463,665 and U.S. Pat. No. 5,040,301 use a single string or cable on the rear sight which only allow for windage adjustment. Still a another prior art of this rear sight variety, application Ser. No. 11/482,381, while twice as costly as the other two, lacks the spatial accuracy as the other designs by mounting both sighting apparatus in close proximity and in front of the bow riser. This last design also appears cluttered as it obscures much of the viewing area of the target with crosshair, aperture, and pin combination.

This invention was developed to address a number of issues associated with other sights and sighting systems. Many manufacturers of front only mounted bow sights have switched from horizontally mounted pins to vertically mounted pins. The advantage of a vertical mounted pin is a clear, unobstructed view of the target. U.S. Pat. No. 5,671,724 and application Ser. No. 11/482,381 use rear crosshair sights and U.S. Pat. No. 7,275,327 and U.S. Pat. No. 6,003,233 uses a v-notch rear sight. This invention uses two rear opposing vertical pins in combination with a single front pin. Also, a single pin, desired by many archers, helps eliminate clutter associated with multiple pins. The two rear vertical pins could be used as additional yardage sights with the upper used for shorter distances and the lower for longer distances. As previously stated, the windage adjustments on other inventions were deemed inadequate for strength; this invention addressed this issue by using a mass to withstand over 700 pounds of torque. Circular rings housing pins are used because the human eye naturally gravitates to the center. This invention uses circular rings for the front and rear to aid in alignment. The combination front and rear vertical pins accomplish two more issues: the low light problems and alignment issues associated with peep sights, as stated earlier, allow the archer to eliminate the peep and thus eliminate those low light and alignment issues; bow torque is observed before the archer releases the arrow to the target eliminating left and right misses. Finally, this invention addresses two issues not addressed in other sights: all in-field adjustments for windage and elevation are accomplished with a single tool; this invention, without alteration, can be installed on either a left-hand or right-hand bow with the front windage, elevation, and pin sight assembly and mounting system parts being identical, interchangeable, and can be considered modular.

While the examples given are illustrative of some of the sights which have been developed to assist an archer in improving shooting accuracy, they all generally either fail to permit adequate sighting during low light shooting conditions or are not built to withstand the rugged outdoors. With so few commercially rear sight in combination with the front sight options available there is obviously still a need in the field of this invention for an improved bow sight which can be used to more accurately aim the bow at a target, without complicating the shooting process, and without further compromising vision during low light situations of dusk and dawn, rugged enough to withstand the abuse it may endure, and make field adjustments with a single tool. The intention of the invention, as outlined, was to build a bow sight to eliminate the use of a peep, have an unobstructed view of the target, and to have a sight which was essentially impervious from damage. After numerous prototypes the realization of this invention had qualities not seen in other archery sights. Additionally, the symmetry and interchangeability of parts are unique to this invention.

BRIEF SUMMARY OF THE INVENTION

The invention generally relates to a bow sight and mounting system which includes a base mounting plate attached to a bow's riser, identical and interchangeable moveable connecting bars, identical and interchangeable adjustable sight mounting brackets, and identical and interchangeable pin sight assembly, all of which can be considered modular.

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a Dual Interchangeable Type Bow Sight for providing an archery sighting system which eliminates the need for a peep on the bow string while assisting the archer in maintaining consistent form to identify and circumvent bow torque.

Another object is to provide a Dual Interchangeable Type Bow Sight that sight area has a large uncluttered field of view.

Another object is to provide a Dual Interchangeable Type Bow Sight that can be mounted on the bow's riser in two different positions to optimize fit.

Another object is to provide a Dual Interchangeable Type Bow Sight that it is interchangeable to fit as a right-hand or left-hand sight.

Another object is to provide a Dual Interchangeable Type Bow Sight that both sight mounting brackets, both connecting hex bars, and both pin sight assemblies are identical and interchangeable.

Another object is to provide a Dual Interchangeable Type Bow Sight that windage and elevation adjustments are accomplished using a single tool.

Another object is to provide a Dual Interchangeable Type Bow Sight that the entire sight system be built in such a manner as to survive abuse without failure.

Another object is to provide a Dual Interchangeable Type Bow Sight that is a modular sighting assembly allowing for various components to be switched out or combined between alternative designs to arrive at a unique or modified combination as desired by the user.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
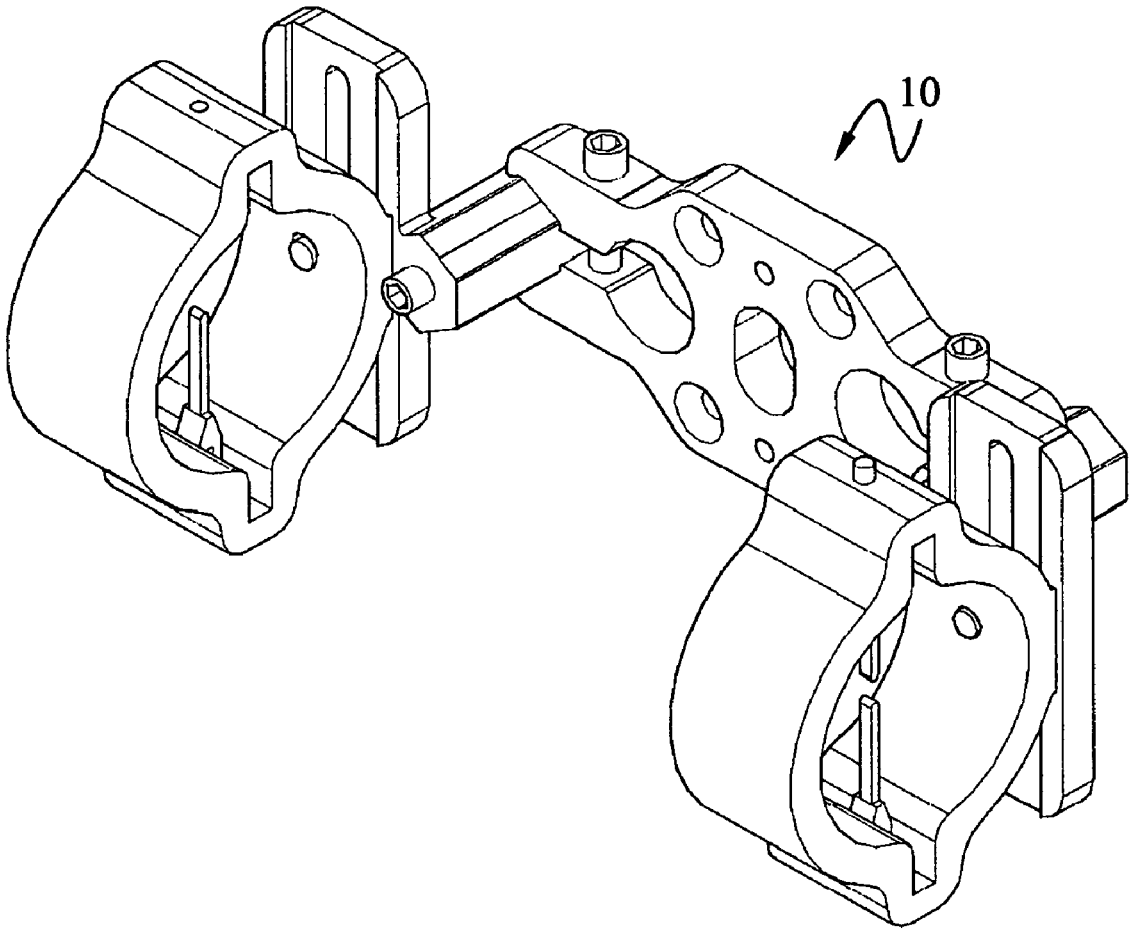
FIG. 1 is an upper perspective view of the present invention. Drawing is a perspective drawing of the bow sight viewed as would be mounted on a right-hand bow. Reversing base mounting plate enables it to be interchangeable for a left-hand or a right-hand bow.

Turning now descriptively to the drawings, in which similar reference characters denote similar elements throughout the several views, the figures illustrate various views of the Dual Interchangeable Type Bow Sight 10 a base mounting plate 12 for mounting to a bow's riser, identical and interchangeable moveable connecting bars 30, identical and interchangeable adjustable sight mounting brackets 40, and identical and interchangeable pin sight assembly 50.

B. Base Mounting Plate 12

The base mounting plate 12 is a contoured elongated symmetrical structure of light-weight material in plate thickness having mirror imaged identical ends comprising of a receiver for accepting a moveable extension bar and having sufficient length to accommodate a sight in forward and rearward positions of a bow riser. The function of said base plate is the mounting to the bow riser, mounting after market accessories, and accepting said moveable extension bar. The symmetry of said base mounting plate enables a bow of left-hand or right-hand design to accept connection without compromise.

Figure 4:
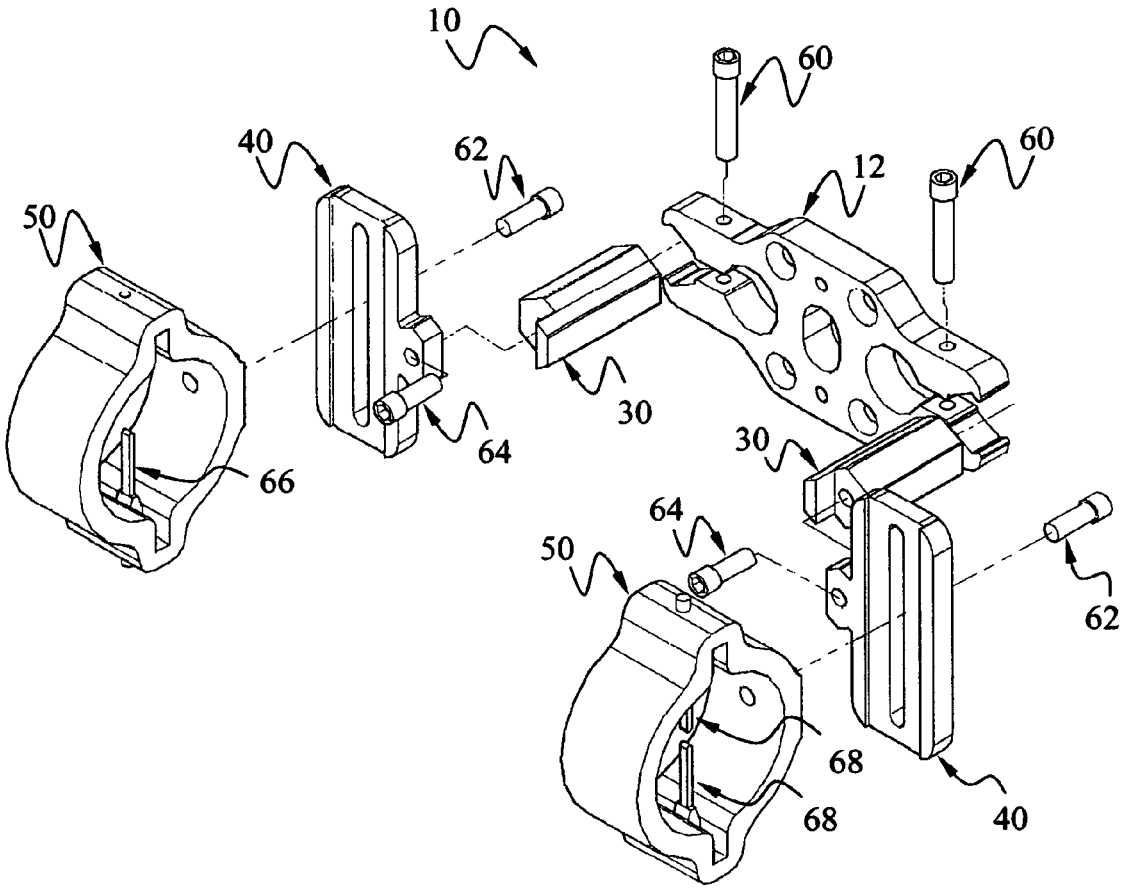
FIG. 4 is an exploded upper perspective view of the present invention. Drawing is an exploded view of the main elements of the archery sight.
Figure 5:
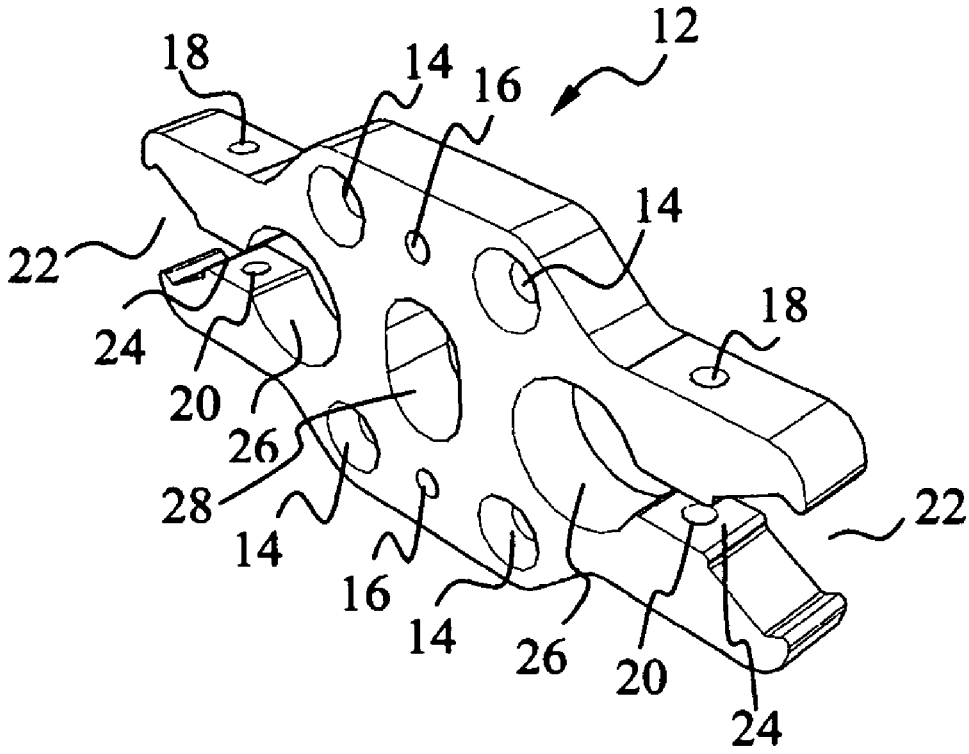
FIG. 5 is an upper perspective view of the present invention. Drawing is perspective detail of the base mounting plate.

Referring to FIG. 4 and FIG. 5, symmetrically designed base mounting plate 12, containing eight countersunk holes 14; four as viewed from the inside and four as viewed from the outside of the mounting plate. Countersunk holes 14 function is mounting on a bow's riser. Symmetry of base mounting plate 12 allows mounting on right-hand designed bows or left-hand designed bows, and forward and rearward position of base mounting plate 12 is relative to the bow design. Countersunk holes 14 allows for the use of commercially sold countersunk screws for flush mounting. Base mounting plate 12 also contains two threaded holes 16 whereas spacing of said threaded holes 16 accepts commercial after-market accessories. Two holes 18 accept the pass through of commercially sold fastener 60. Two threaded holes 20 accept the threads of fastener 60. Tightening or loosening said fastener 60 compresses or relaxes compression space 24 and decreases or increases opening of compression slots for extension bar 22. Flexibility of said compression slots for extension bar 22 is dependent on compression cutout area 26. Center cutout area 28 is for purpose of weight reduction.

C. Moveable Connecting Bars 30

The identical and interchangeable moveable connecting bars 30 structures is a commercially available hex bar stock. The function of said moveable connecting bars 30 is to permit windage, or side-to-side adjustment, and is of sufficient length to accomplish this purpose. The moveable connecting bars 30 is connected to the base mounting plate through previously stated compression slots for extension bar and secured with a fastener.

Figure 6:
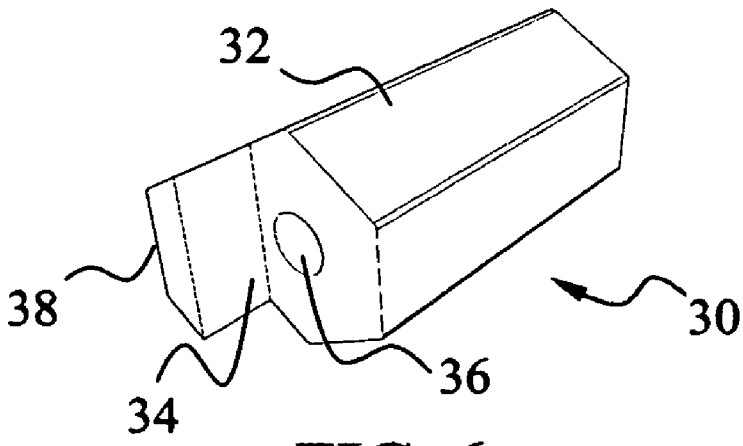
FIG. 6 is an upper perspective view of the present invention. Drawing is perspective detail of the moveable connecting bars.

Referring to FIG. 4 and FIG. 6, one end of bar 32 of moveable connecting bars 30 is recessed to create ear mounting slot 34 to a depth made to match the thickness of sight mounting brackets 40. Width of said ear mounting slot 34 is sufficient to ensure hole 44 in mounting ear 42 of said sight mounting brackets 40 matches the position of threaded hole 36 on said moveable connecting bars 30. The design of said ear mounting slot 34 is a means of connection and mating of said mounting ear 42. The anti-rotation ear 38 is designed to prevent rotation of identical and interchangeable said sight mounting brackets 40. Threaded hole 36 is of sufficient depth to accept standard commercially available fastener 64. Both moveable connecting bars 30 are identical in every respect and are interchangeable. This component is considered to be modular and could be replaced by an alternative component suited to be substituted with this or another portion of the invention.

D. Sight Mounting Brackets 40

The identical and interchangeable sight mounting brackets 40 are a rectangular shaped structure of plate thickness. The function of said sight mounting brackets is to provide a means for elevation adjustments of the pin sight assembly 50. A shallow wide slot 46 is produced in each said sight mounting plate as a means to connect to a mating portion on said pin sight assembly 50.

Figure 7:
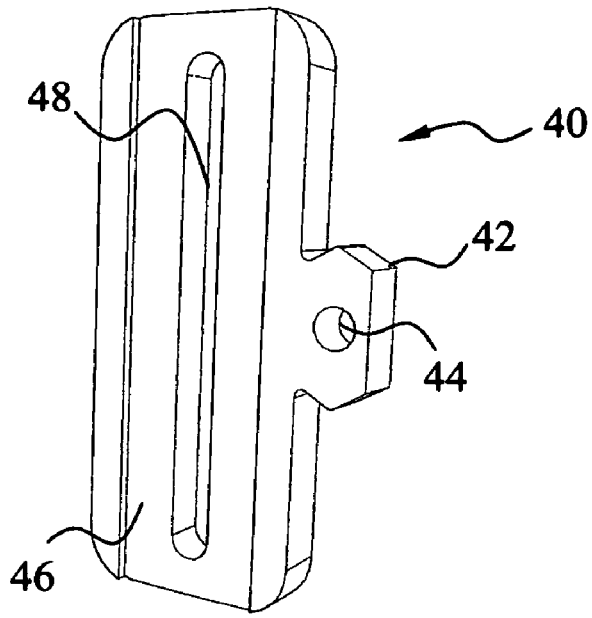
FIG. 7 is an upper perspective view of the present invention. Drawing is perspective detail of the sight mounting brackets.

Referring to FIG. 1, FIG. 4, and FIG. 7, the contour geometry of mounting ear 42 of sight mounting brackets 40 matches the hex shape of moveable connecting bars 30 when connected in recessed area for ear mounting slot 34 through hole 44 to threaded hole 36 with fastener 64 as illustrated in FIG. 1 ensuring sight mounting brackets 40 will not rotate in space. Wide slot 46 is shaped to a width wide enough to ensure a stable platform for rise 54 and a depth deep enough to ensure pin sight assembly 50 does not rotate when fasten through small slot 48 with fastener 62. Length of small slot 48 is of sufficient length to move pin sight assembly 50 up and down for all typical target acquisition elevation positions. Both sight mounting brackets 40 are identical in every respect and are interchangeable. This component is considered to be modular and could be replaced by an alternative component suited to be substituted with this or another portion of the invention.

E. Pin Sight Assembly 50

The pin sight assembly 50 structure is composed of durable high impact translucent material. Said pin sight assembly 50 is generally circular in shape with a depth approximately one half the diameter of said circular sight. The diameter of said pin sight assembly 50 is large enough to permit ample field of view. The function of said pin sight assembly 50 in the forward position is to house a single commercially available replaceable t pin 66 allowing for target acquisition. The function of said pin sight assembly 50 in the rearward position is to house two commercially available replaceable pins 68, of different color, located in opposition for position centering of said forward pin 66 in said pin sight assembly 50 in the forward position. Pin sight assembly 50 is connected to one of the sight mounting brackets 40 as a rise 54 on said forward pin sight assembly 50 is mated into the previous said wide slot 46 and secured with fastener 62. The pin sight assembly 50 component is considered to be modular and could be replaced by an alternative component suited to be substituted with this or another portion of the invention.

Figure 8:
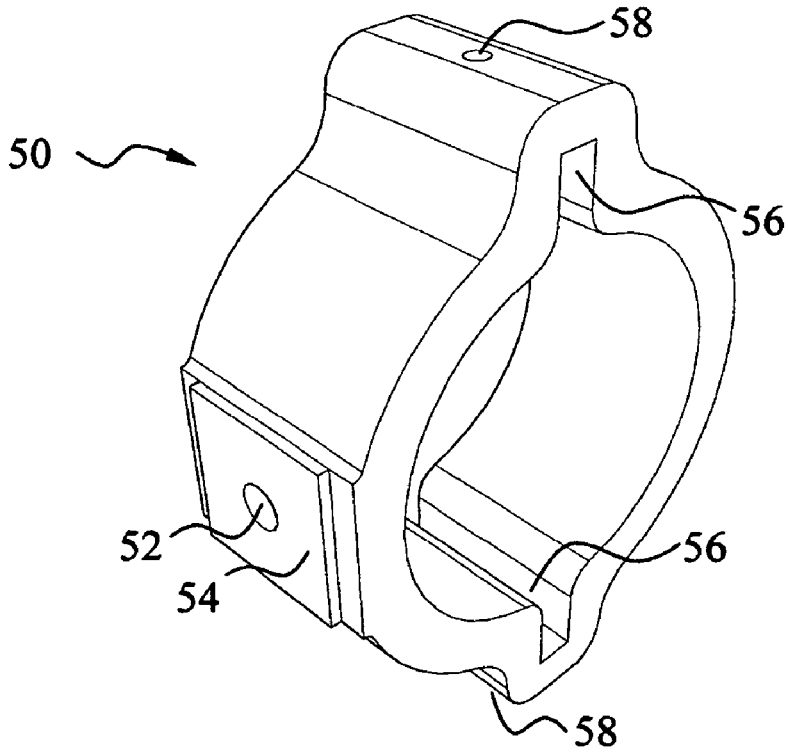
FIG. 8 is an upper perspective view of the present invention. Drawing is perspective detail of the pin sight assembly.

Referring to FIG. 4 and FIG. 8, rise 54 on pin sight assembly 50 is shaped to a width easily moveable when mated to wide slot 46 in sight mounting brackets 40. Rise 54 is shaped to match the depth of wide slot 46 in sight mounting brackets 40. Hole 52 in the center of rise 54, accepts a commercially available threaded insert. Said threaded insert is also known as a "heli-coil". Hole 58 in the center of long slot 56 accepts a fastener for commercially available replaceable pin 66 and pins 68.

F. Connections of Main Elements and Sub-Elements of Invention

Referring to FIG. 4 and FIG. 5, the base mounting plate 12 is fasten to a right-hand or left-hand commercially sold bow with commercially available countersunk screws through either of the two vertically opposing countersunk holes 14. Countersunk hole selection has two preference positions based on bow design and archers personal preference. One of the two forward vertically opposing countersunk holes 14 is paired for one mounting position and the other rearward vertically opposing countersunk holes are paired to constitute a second mounting position. Either mounting positions will fit any commercially sold bow. Moveable connecting bars 30 are inserted through compression slots for extension bar 22 on the base mounting plate 12 and fastened with fastener 60 through holes 18 and secured into threaded holes 20. Sight mounting brackets 40 are mounted to the moveable connecting bars 30 by mating mounting ear 42 to ear mounting slot 34 with fastener 64 through hole 44 and secured into threaded hole 36. Pin sight assembly 50 is mounted to sight mounting brackets 40 by mating rise 54 into wide slot 46 with one of the fastener 62 through small slot 48 and secured to threaded insert in hole 52. For making in-field windage and elevation adjustments fastener 60 and fastener 62 are adjusted using the same tool. The commercially available replaceable pin 66 and pins 68 is inserted into long slot 56 of pin sight assembly 50 and is secured with the commercially available replaceable pin fastener through hole 58.

G. Alternative Embodiments of Invention

Figure 2:
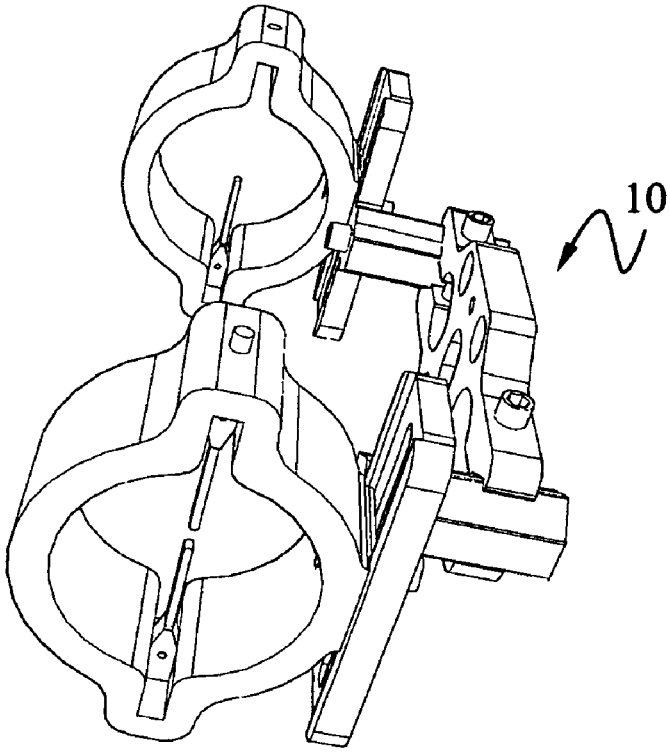
FIG. 2 is an upper perspective view of the present invention. Drawing is a perspective drawing of the bow sight viewed as an archer looking from a "bird's eye" view.
Figure 3:
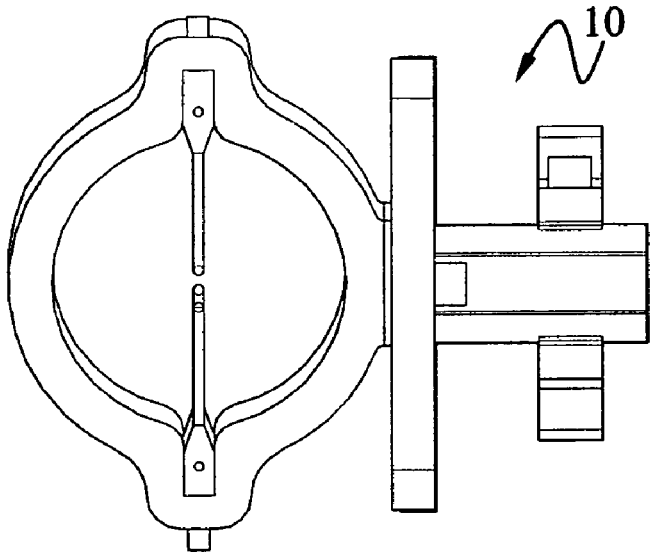
FIG. 3 is a rear view of the present invention. Drawing is a rear view of the sight as the archer would see the sight pins when aiming through the sight.

Referring to FIG. 1, FIG. 2, and to FIG. 3 it can be seen the intended use of this invention is to position forward sight pin 66 in the center of rearward sight pins 68 for target acquisition. While a circular sight aids the archer in naturally centering, altering the geometric shape of the sight pin assembly does not alter the functionality of this invention.

Referring to FIG. 6 and FIG. 7, moveable connecting bars 30 and sight mounting brackets 40 are separate main elements. As an alternative, production processes could mold both elements into a single main element thus eliminating secondary operations and connections of said moveable connecting bars 30 to said sight mounting brackets 40.

H. Operation of Preferred Embodiment

The connections of main elements and sub-elements have already been described and are shown in FIG. 1 and FIG. 4. The choice of which countersunk holes to use, as already stated, may be of personal preference or bow design. In most cases the choice of which countersunk mounting hole is personal preference. Some bows have an extended brace in the rear of the bow grip area. In cases such as this, the base mounting plate 12 must use the rearward countersunk holes. The archery industry sets standards for diameter of threaded fasteners for mounting "bow sight side plates" to the bow's riser and countersunk holes 14 meets those standards. The archery industry also sets standards for location spacing of the threaded fasteners for mounting "bow sight side plates" to the bow's riser and these location standards of countersunk holes 14 in base mounting plate 12 meet the industry's location standards. Accessories, such as arrow quivers, may be mounted to the base mounting plate 12 by using threaded holes 16. The archery industry sets standards for spacing for accessories and the spacing of threaded holes 16 in base mounting plate 12 meets the industry standards.

Because base mounting plate 12 is symmetrical the same plate can be used on a left-hand or right-hand designed bow. Also, the plate may be mounted with holes 18 positioned facing upward or facing downward. It is, however, preferable to position holes 18 facing upward, as shown in FIG. 4 and FIG. 5, in the event the archer, while making windage adjustments, forgets to tighten the fasteners. Positioning holes 18 facing upward will prevent the fasteners from falling out and being lost as might be the case if holes 18 were facing downward.

Because moveable connecting bars 30 and sight mounting brackets 40 are identical and symmetrical, elements may be exchanged to mount in the forward or rearward position whether base mounting plate 12 is mounted on the riser of a right-hand bow or the riser on a left-hand bow.

Because pin sight assembly 50 is symmetrical, mounting to sight mounting brackets 40 in the right-hand riser position or left-hand riser position may be made in a plurality of ways.

Referring to FIG. 1 and FIG. 2, pin sight assembly 50 in the forward position shows pin 66 mounted in the lower position of long slot 56. The archer has two choices when mounting pin sight assembly 50 in the forward position to sight mounting brackets 40 on a right-hand bow riser or left-hand bow riser. Pin sight assembly 50 may be mounted to have pin 66 positioned in lower long slot 56 as shown in FIG. 1 and FIG. 2, or pin sight assembly 50 may be mounted to have pin 66 positioned in the upper long slot 56. Since pin 66 in the forward positioned pin sight assembly 50 is centered between the two pins 68 in the rearward positioned pin sight assembly 50, the orientation of pin 66 downward or upward is insignificant. Of importance is rotation of pin 66 is visible to the archer when in the shooting position. Pin 66 may be removed, rotated 180 degrees, and re-secured so as to be visible to the archer.

Operations of the remaining main elements involve windage and elevation adjustments. After an archer nocks an arrow and shoots at a target, if the arrow impacts too low, forward pin sight assembly 50 is moved downward by loosening fastener 62 and sliding forward pin sight assembly 50 downward. If the arrow impacts too high, forward pin sight assembly 50 is moved upward by loosening fastener 62 and sliding forward pin sight assembly 50 upward.

After an archer nocks an arrow and shoots at a target, if the arrow impacts too far to the right, moveable connecting bars 30 is moved to the right by loosening fastener 60 and sliding moveable connecting bars 30 to the right. If the arrow impacts too far to the left, move moveable connecting bars 30 to the left by loosening fastener 60 and sliding moveable connecting bars 30 to the left.

Rearward mounted pin sight assembly 50 adjustments should match the placement of the forward mounted pin sight assembly. Upward, downward, left or right adjustments of the rearward mounted pin sight assembly 50 should match upward, downward, left or right adjustments of the forward mounted pin sight assembly. Small adjustments to forward mounted pin sight assembly 50 may be made without adjustments to rearward mounted pin sight assembly. As previously mentioned, fastener 60 and fastener 62 for making in-field windage and elevation adjustments are made with the same tool. In the event fastener 64 requires tightening the same tool can be used as was for fastener 60 and fastener 62.

What has been described and illustrated herein is a preferred embodiment of the invention along with some of its variations. Each main element component is considered to be modular and could be replaced by an alternative component suited to be substituted with this or another portion of the invention. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

INDEX OF ELEMENTS

Dual Interchangeable Type Bow Sight 10

10: Base Mounting Plate 12
11: Countersunk Holes 14
12: Threaded Holes 16
13: Holes 18
14: Threaded Holes 20
15: Compression Slots for Extension Bar 22
16: Compression Space 24
17: Compression Cutout Area 26
18: Center Cutout Area 28
19: Fastener 60
20: Moveable Connecting Bars 30
21: Bar 32
22: Ear Mounting Slot 34
23: Threaded Hole 36
22: Anti-Rotation Ear 38
30: Sight Mounting Brackets 40
31: Mounting Ear 42
32: Hole 44
33: Wide Slot 46
34: Small Slot 48
35: Fastener 62
36: Fastener 64
40: Pin Sight Assembly 50
41: Hole 52
42: Rise 54
43: Long Slot 56
44: Hole 58
45: Pin 66
46: Pins 68

The invention claimed is:

1. An improved bow sight mounting system for accurate targeting comprising of:

a. a mirror-image symmetrical base mounting plate for attachment to the riser of the bow and the remainder of said bow sight mounting system;

b. a mirror-image symmetrical windage and elevation adjustment assembly forward of the bow riser slideably adjustable mounted to said base mounting plate;

c. a mirror-image symmetrical windage and elevation adjustment assembly rearward of the bow riser identical in every aspect, interchangeable, and of modular design to the forward of the bow riser windage and elevation adjustment assembly slideably adjustable mounted to said base mounting plate;

d. a circular mirror-image symmetrical pin sight assembly forward of the bow riser slideably adjustable mounted to said windage and elevation adjustment assembly;

e. a circular mirror-image symmetrical pin sight assembly rearward of the bow riser identical in every aspect, interchangeable, and of modular design to the forward of the bow riser circular symmetrical pin sight assembly slideably adjustable mounted to said windage and elevation adjustment assembly;

f. fiber optic sight pin mounted vertically and approximately centered in the said circular mirror-image symmetrical pin sight assembly forward of the bow riser;

g. two fiber optic sight pins centered in the said circular mirror-image symmetrical pin sight assembly rearward of the bow riser mounted vertically in opposition to one another and spaced sufficiently apart to visually view fiber optic pin mounted in said circular mirror-image symmetrical sight assembly forward of the bow riser, when aligned for targeting.

2. The bow sight mounting system of claim 1 wherein said base mounting plate is of mirror-image symmetrical design around the mid-axis in the sagital plane; around the mid-axis in the transverse plane; and around the mid-axis in the frontal plane allowing for equal functionality on left-hand or right-hand bows with no discernable forward, rearward, right-side up, upside-down, front-side, back-side, inside, outside orientation.

3. The bow sight mounting system of claim 2 wherein said base mounting plate is capable of being mounted in two positions for a more forward or more rearward location on either left-hand or right-hand bows with no discernable forward, rearward, right-side up, upside-down, front-side, back-side, inside, outside orientation.

4. The bow sight mounting system of claim 1 wherein said mirror-image symmetrical windage and elevation adjustment assembly forward of the bow riser and mirror-image symmetrical windage and elevation adjustment assembly rearward of the bow riser is symmetrical around the mid-axis in the transverse plane.

5. The bow sight mounting system of claim 4 wherein both forward of the bow riser and rearward of the bow riser of said symmetrical windage and elevation adjustment assembly are identical in every aspect, unidentifiably different, and interchangeable being of modular design.

6. The bow sight mounting system of claim 1 wherein the circular mirror-image symmetrical sight assembly forward of the bow riser and the circular mirror-image symmetrical pin sight assembly rearward of the bow riser is symmetrical around the mid-axis in the sagital plane; around the mid-axis in the terse plane; and around the mid-axis in the frontal plane.

7. The bow sight mounting system of claim 6 wherein both circular mirror-image symmetrical pin sight assembly forward of the bow riser and rearward of the bow riser are identical in every aspect, unidentifiably different, and interchangeable being of modular design.

8. The bow sight alignment system claim 7 having an improved configuration wherein when:

a. the bow is properly aligned and aimed the fiber optic sight pin mounted within said pin sight assembly forward of the bow riser is visible between the space of two vertically opposed spaced fiber optic sight pins mounted in the said pin sight assembly rearward of the bow riser for accurate targeting;

b. the bow is improperly aligned and aimed the visual alignment of bow-torque is noted in the frontal plane by the misalignment of the front pin in the forward of the bow riser pin sight assembly is left or right of the two vertically spaced pins in the rearward of the bow riser pin sight assembly;

c. canter from an improperly aligned and aimed bow is noted in the sagital plane when the two vertically spaced pins in the rearward pin sight assembly is other than an orientation of 90 degree top vertical fiber optic sight in and 270 degree bottom vertical fiber optic sight pin.

9. The improved configuration of claim 8 wherein the said vertically opposed spaced fiber optic sight pins mounted within the pin sight assembly rearward of the bow riser have a plurality of use as alignment for secondary and tertiary acquisition.

10. The improved configuration of claim 8 wherein said pin sight assembly forward of the bow riser with a single fiber optic sight pin produces three points of alignment when aligned with said two vertically opposed spaced fiber optic sight pins within the pin sight assembly rearward of the bow riser; and wherein the addition of a second fiber optic sight pin mounted in the forward of the bow riser pin sight assembly provides six points of alignment when in alignment with the two vertically opposed spaced fiber optic sight pins within the pin sight assembly rearward of the bow riser.

11. The bow sight mounting system of claim 10 wherein the number of fiber optic sight pins used in the forward of the bow riser pin sight assembly is determined by the user.

* * * * *